US008091751B2

(12) United States Patent
Tanaka

(10) Patent No.: US 8,091,751 B2
(45) Date of Patent: Jan. 10, 2012

(54) GAS INTERNAL COMBUSTION TYPE NAILING MACHINE

(75) Inventor: Hiroshi Tanaka, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 12/594,242

(22) PCT Filed: Mar. 28, 2008

(86) PCT No.: PCT/JP2008/056130

§ 371 (c)(1),
(2), (4) Date: Oct. 1, 2009

(87) PCT Pub. No.: WO2008/120730

PCT Pub. Date: Oct. 9, 2008

(65) Prior Publication Data

US 2010/0108736 A1 May 6, 2010

(30) Foreign Application Priority Data

Apr. 2, 2007 (JP) ..... 2007-096166

(51) Int. Cl.
*B25C 1/08* (2006.01)

(52) U.S. Cl. ..... 227/10; 227/9; 227/11; 227/156

(58) Field of Classification Search ..... 227/9, 10, 227/11, 156

See application file for complete search history.

(56) References Cited

U.S. PATENT DOCUMENTS

| | | | | | |
|---|---|---|---|---|---|
| 4,040,164 | A | * | 8/1977 | Briles | 29/432 |
| 4,040,554 | A | * | 8/1977 | Haytayan | 227/8 |
| 4,365,471 | A | * | 12/1982 | Adams | 60/39.76 |
| 4,377,991 | A | * | 3/1983 | Liesse | 123/46 SC |
| 4,665,868 | A | * | 5/1987 | Adams | 123/46 SC |
| 4,721,240 | A | | 1/1988 | Cotta | |
| 4,773,581 | A | * | 9/1988 | Ohtsu et al. | 227/10 |
| 4,813,492 | A | * | 3/1989 | Biek | 173/2 |
| 5,020,712 | A | * | 6/1991 | Monacelli | 227/8 |
| 2002/0158102 | A1 | * | 10/2002 | Patton et al. | 227/8 |
| 2004/0134961 | A1 | | 7/2004 | Wolf et al. | |

FOREIGN PATENT DOCUMENTS

| | | |
|---|---|---|
| JP | 2-92035 | 7/1990 |
| JP | 4-48589 | 8/1992 |
| JP | 4-314922 | 11/1992 |
| JP | 8-61104 | 3/1996 |
| WO | WO-2007/000031 A1 | 1/2007 |

* cited by examiner

*Primary Examiner* — Brian D Nash
(74) *Attorney, Agent, or Firm* — Drinker Biddle & Reath LLP

(57) ABSTRACT

A gas internal combustion type nailing machine including a striking cylinder for slidably accommodating a striking piston therein, a combustion chamber formed in an upper side and capable of being opened and closed, a compressor for supercharging compressed air into the combustion chamber, a fuel supply device for supplying a fuel gas into the combustion chamber, and a safety device for preventing the nailing machine from being driven for ignition when the supercharge pressure of the compressed air exceeds a set pressure value.

8 Claims, 9 Drawing Sheets

GAS INTERNAL COMBUSTION TYPE NAILING MACHINE

TECHNICAL FIELD

The present invention relates to a gas internal combustion type nailing machine. Specifically, the invention relates to a gas internal combustion type nailing machine which takes measures to cope with an unexpected increase in supercharge pressure.

BACKGROUND ART

A gas internal combustion type nailing machine is conventionally known (for example, see the patent reference 1) and, in this type of nailing machine, there is also known a nailing machine which aims at increasing the output energy thereof by supercharging compressed air into a combustion chamber.

In these well-known gas internal combustion type nailing machines, there are taken measures to maintain a proper air-fuel ratio in order to secure a good combustion state and, for this purpose, there is provided means for adjusting a fuel injection amount based on an air supply amount into the combustion chamber.

For example, a certain known gas internal combustion type nailing machine of a supercharge type has a structure which supplies compressed air and fuel into a combustion chamber through their individual supply pipes. A supply of a predetermined amount of fuel to be supplied into the combustion chamber is carried out using a quantity measuring valve to be controlled by mechanical or electronic control means provided in the fuel supply pipe (for example, see the patent reference 2).

[Patent Reference 1] JP-B-04-048589

[Patent Reference 2] US 2004/0134961A1

In the above gas internal combustion type nailing machine, in order to maintain a proper air-fuel ratio, the fuel supply amount is adjusted based on the air supply amount. This adjustment of the fuel supply amount is carried out by linking the air supply amount and the fuel supply amount with each other. In the fuel supply using the quantity measuring valve to be controlled by the mechanical or electronic control means of the gas internal combustion type nailing machine disclosed in the above patent reference 2 as well, the fuel supply amount is adjusted in linking with the air supply amount.

Here, according to the above method for supplying the fuel in linking with the air supply amount, for example, even when, in the gas internal combustion type nailing machine of a supercharge type, an excessive amount of compressed air is supplied for some reason and thus the supercharge pressure exceeds a given pressure value, as long as the compressed air is supplied continuously, the fuel is supplied based on the air supply amount.

However, by a combustion in a high supercharge pressure exceeding a given pressure value, the explosion energy of such combustion exceeds the output energy that is set previously. And, when such excessive output energy is generated, the nailing machine is excessively loaded physically, which has ill influences on the durability and safety of the nailing machine. Therefore, from the viewpoint of securing the durability and safety of the nailing machine, it is necessary to take effective measures to eliminate such ill influences.

SUMMARY OF INVENTION

One or more embodiments of the invention provide a gas internal combustion type nailing machine that carries out special measures such as a cutoff of a fuel supply, a disabling of an operation of a spark plug, and a reduction of a supercharge pressure through expansion of a volume of an inside of a combustion chamber, when the supercharge pressure exceeds a set pressure value, so as to prevent or restrict a generation of an excessive combustion energy which exceeds a set output energy, thereby being able to secure a durability and a safety of the nailing machine.

In accordance with one or more embodiment of the present invention, a gas internal combustion type nailing machine is provided with: a striking cylinder for slidably accommodating a striking piston therein; a combustion chamber formed in an upper side of the striking cylinder and capable of being opened and closed; a compressor for supercharging compressed air into the combustion chamber; a fuel supply device for supplying a fuel gas into the combustion chamber; and a safety device for preventing the nailing machine from being ignited and driven when the supercharge pressure of the compressed air exceeds a set pressure value.

As the safety device, there may also be provided a control valve which is structured such that, when the supercharge pressure exceeds the set pressure value, it can cut off the supply of the fuel by the fuel supply device.

When, as the safety device, there is provided the control valve which is structured such that, when the supercharge pressure exceeds the set pressure value, it can cut off the supply of the fuel by the fuel supply device, even if the compressed air is supplied on in a state where the supercharge pressure exceeds the set pressure value, the supply of the fuel is cut off completely by the control valve, with the result that the mixed fuel within the combustion chamber is diluted to thereby be unable to provide a proper air-fuel ratio, whereby the mixed fuel cannot be combusted or can be combusted only incompletely. Therefore, even when there occurs an unexpected phenomenon that the supercharge pressure increases, it is possible to prevent the generation of such excessive explosion energy due to combustion under high pressure as can have ill influences on the durability and safety of the nailing machine.

The safety device may also be structured such that, when the supercharge pressure exceeds the set pressure value, it releases the supercharge pressure from the combustion chamber into the striking cylinder.

When the safety device is structured such that, when the supercharge pressure exceeds the set pressure value, it releases the supercharge pressure from the combustion chamber into the striking cylinder, the mixed gas of high supercharge pressure flows into the striking cylinder when the supercharge pressure exceeds the set pressure value. As a result of this, the striking piston is pressed down due to the supercharge pressure to, substantially, expand the volume of the combustion chamber. This reduces the supercharge pressure within the combustion chamber to thereby restrict the explosion energy generated due to combustion. This can positively prevent the generation of such excessive explosion energy due to combustion under high pressure as can have ill influences on the durability and safety of the nailing machine.

The safety device may also be structured such that, by controlling the electric circuit of an ignition control device according to a detect signal from a pressure sensor for detecting the pressure exceeding the set pressure value within the combustion chamber, it can disable the turn-ON operation of a switch which is used to ignite a mixed gas within the combustion chamber.

When the safety device is structured such that, by controlling the electric circuit of an ignition control device according to a detect signal from a pressure sensor for detecting the pressure exceeding the set pressure value within the combustion chamber, it can disable the turn-ON operation of the switch for the ignition and combustion, in a state where the supercharge pressure exceeds the set pressure value, the operation of the switch is disabled, with the result that the mixed gas is positively prevented against ignition. Therefore, even when there occurs a phenomenon that the supercharge pressure increases for some unexpected reasons, it is possible to positively prevent the generation of such excessive explosion energy due to combustion under high pressure as can have ill influences on the durability and safety of the nailing machine.

As the safety device, there may also be provided a cylinder mechanism structured such that, as the pressure within the combustion chamber exceeds the set pressure value, it can be operated to disable the turn-ON operation of a switch which can be operated by a trigger to turn ON and thus ignite the mixed gas within the combustion chamber. Also, the cylinder mechanism may also be structured such that it can be operated according to such pressure within the combustion chamber as exceeding the set pressure value to move the contact member of the switch to a position where it cannot be engaged with the trigger.

In this case, the contact member of the switch for ignition and combustion is pushed by operating the trigger to thereby ignite and combust the mixed gas composed of fuel gas and air supercharged into the combustion chamber; and also, using the cylinder mechanism which can be operated according to such pressure within the combustion chamber as exceeding the set pressure value, the contact member of the switch is moved to the position where it cannot be engaged with the trigger, whereby, when the pressure within the combustion chamber exceeds the set pressure value, the contact member of the switch cannot be pushed, thereby being able to positively prevent the nailing machine from starting.

Also, the cylinder mechanism may also include a piston rod which is structured such that it can be operated according to such pressure within the combustion chamber as exceeding the set pressure value to move to a position where it interferes with the trigger.

In this case, since the piston rod of the cylinder mechanism so structured as to operate according to such pressure within the combustion chamber as exceeding the set pressure value is moved to a position where it interferes with the trigger, it is impossible to operate the trigger effectively. Therefore, the start operation of the nailing machine can be prevented.

The safety device may also be structured such that, when the supercharge pressure exceeds the set pressure value, it does not link the air supply amount to the combustion chamber with the fuel injection amount by the fuel supply device but supplies a constant amount of fuel using the fuel supply device.

In this case, since the supercharge pressure by the compressor and the fuel injection amount by the fuel supply device are set separately from each other, even when the supercharge pressure exceeds the set pressure value, the fuel injection amount is constant and thus it does not increase further. Owing to this, when the supercharge pressure increase, in short, only the air amount increases when compared with the fuel gas and thus the mixed gas is diluted. Therefore, even when the mixed gas is ignited, it cannot be combusted, or even when the mixed gas is combusted, such combustion cannot produce any power. Thus, since the resultant energy is lower than the set energy, the durability and safety of the nailing machine can be secured.

Other aspects and advantages of the invention will be apparent from the following description, the drawings and the claims.

DESCRIPTION OF REFERENCE NUMERALS

Figure 1:
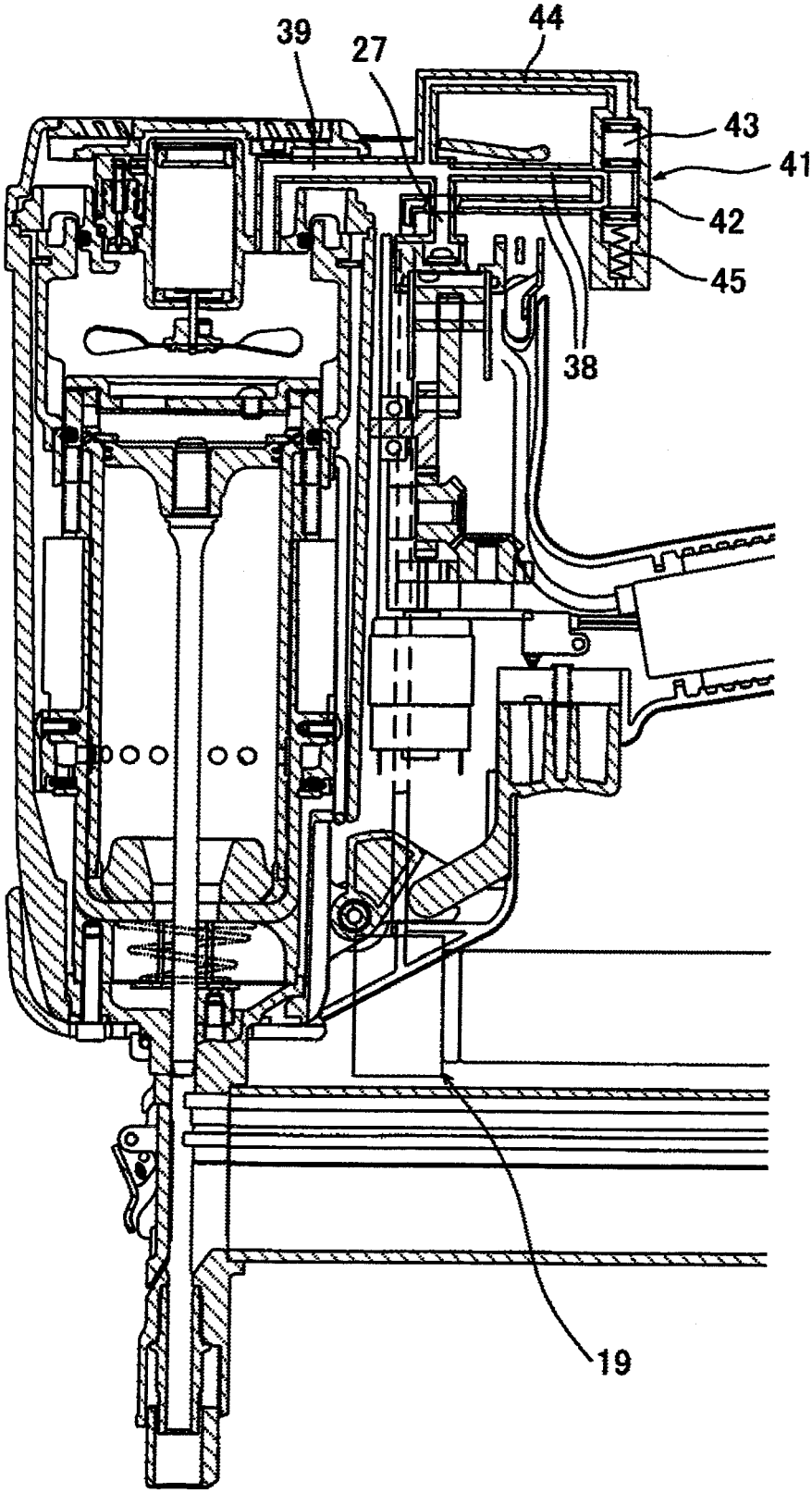
FIG. 1 is a longitudinal section view of the main portions of a gas internal combustion type nailing machine according to a first exemplary embodiment of the invention.

5: Striking cylinder
6: Striking piston
8: Movable housing
11: Combustion chamber
19: Fuel supply device
25: Compressor
41: Fuel supply control valve

BEST MODE FOR CARRYING OUT THE INVENTION

Now, description will be given below of exemplary embodiments of the invention. Firstly, description will be given of a basic structure used in common in the embodiments of the invention with reference to a gas internal combustion type nailing machine A shown in FIGS. 8 and 9. After then, description will be given of individual embodiments in which the supercharge pressure caused by the compressed air to be supplied into a combustion chamber for supercharging exceeds a given pressure value.

Figure 8:
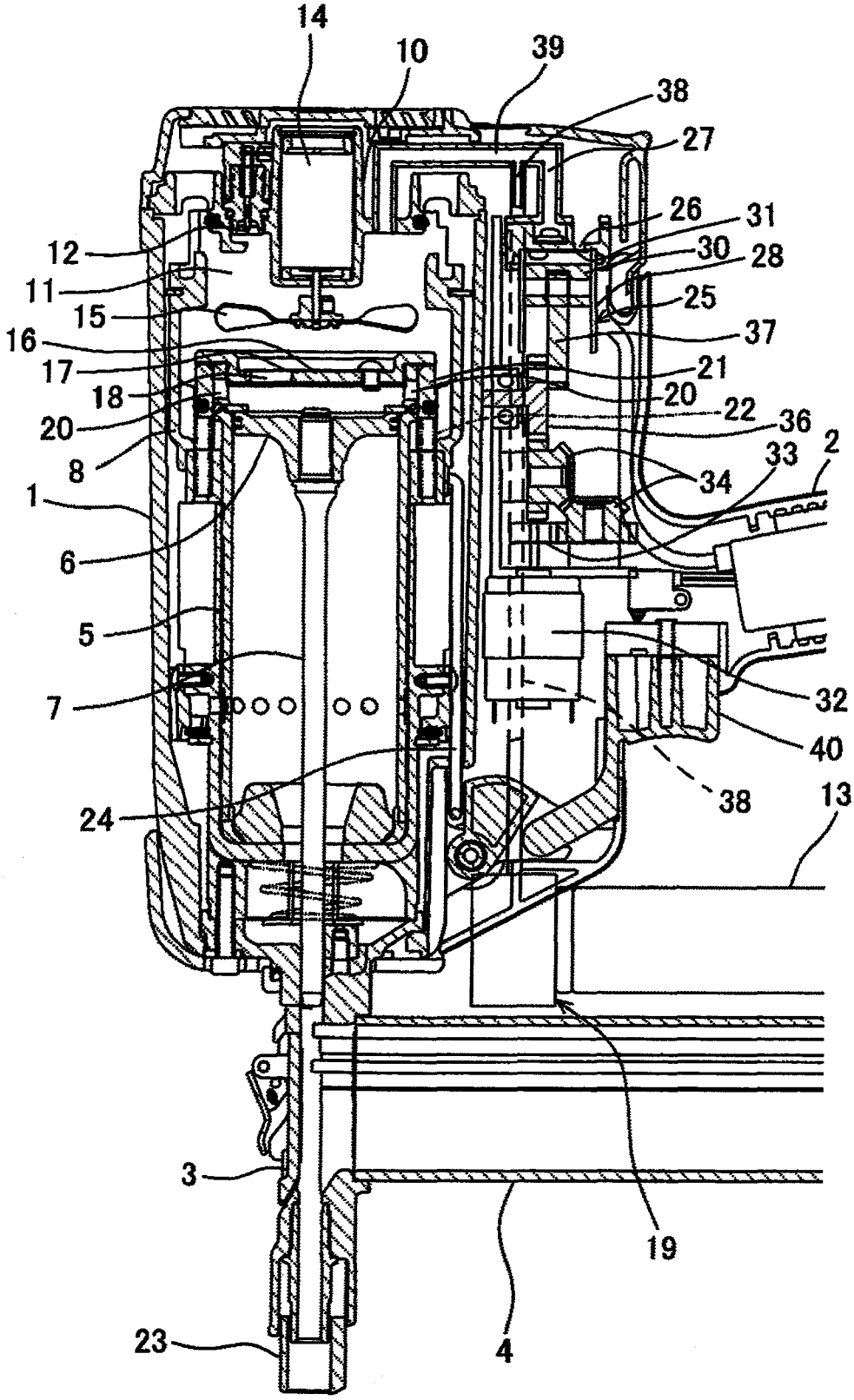
FIG. 8 is a longitudinal section view of a basic structure used in common in the respective exemplary embodiments of the invention.
Figure 9:
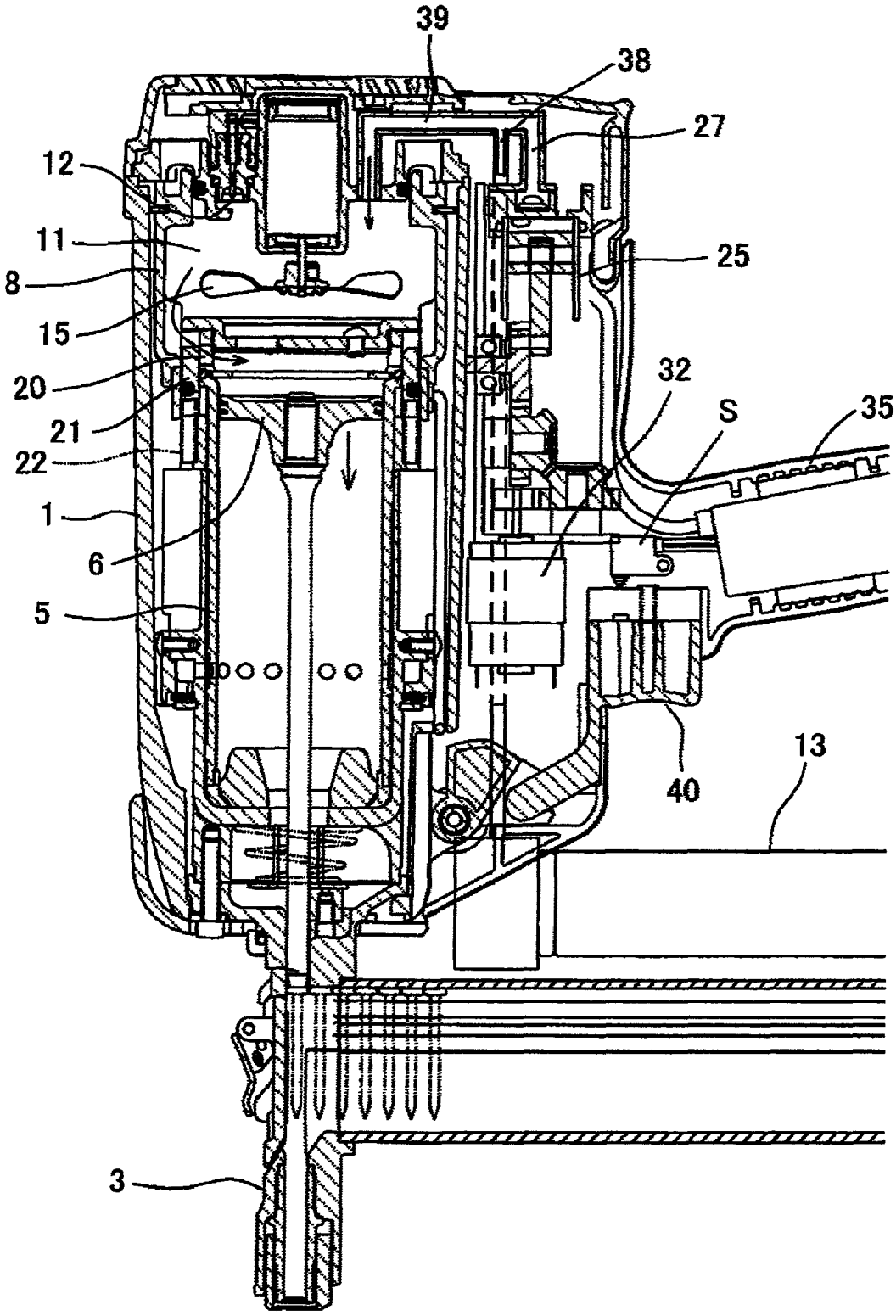
FIG. 9 is a longitudinal section view of the main portions of the gas internal combustion type nailing machine shown in FIG. 8, showing the operation state thereof.

FIGS. 8 and 9 respectively show a gas internal combustion type nailing machine which is provided with: a nailing machine main body 1 for accommodating therein a drive mechanism portion, a gas fuel cartridge and the like; a grip 2 formed integrally with the nailing machine main body 1; a nose portion 3 projecting from the lower portion in FIGS. 8 and 9 of the nailing machine main body 1; and, other composing elements. Here, reference numeral 4 designates a magazine for supplying nails to the injection port of the nose portion 3.

The drive mechanism portion is provided with: a cylindrical-shaped striking cylinder 5; a striking piston 6 slidable reciprocatingly within the striking cylinder 5 in the vertical direction in FIGS. 8 and 9; a driver 7 fixed to the striking piston 6; a combustion chamber 11 formed of a space which is surrounded by a tubular-shaped movable housing 8 and an upper cylinder head portion 10 respectively situated upwardly of the striking cylinder 5 and also which is separated by the upper surface of the striking piston 6; a spark plug 12 mounted on the upper cylinder head portion 10 of the combustion chamber 11; a stirring fan 15 which can be driven by a motor 14 for mixing a combustible fuel gas supplied from a gas fuel cartridge 12 with air; and, other composing elements.

Here, the combustion chamber 11 and striking cylinder 5 are separated from each other by a separation member 16, while they are allowed to communicate with each other through an opening 18 including a check valve 17 made of a plate spring.

Next, in the upper end side wall of the striking cylinder 5, there is formed a supply port 20 and, between the striking cylinder 5 and combustion chamber 11, there is interposed a ring-shaped head valve 21 which allows the supply port 20 and combustion chamber 11 to communicate with each other or cuts off them from each other. The head valve 21 is disposed to be movable vertically along the upper side surface of the striking cylinder 5, and it is normally energized upwardly by a push-up spring 22 provided on the lower portion thereof so as to close the supply port 20. The spring force of the push-up spring 22 is set to such a degree that, when the internal pressure of the combustion chamber 11 is raised due to combustion, the push-up spring 22 cannot hold the head valve 21 in the closed state thereof.

Also, there is provided a contact member 23 which carries out an initial operation for substantially starting the drive mechanism portion. In a state where the nailing machine is not used to carry out its nail driving operation, the lower end of the contact member 23 is energized by a spring so as to project from the lower-most portion of the nose portion 3, and the upper end of a rod member 24 provided on the upper portion of the contact member 23 is connected to the lower end portion of the movable housing 8 of the combustion chamber 11, whereby the movable housing 8 of the combustion chamber 11 is moved downward and is thus open to the air.

The gas internal combustion type nailing machine further includes a compressor 25 for supercharging in the rear space of the nailing machine main body 1. The compressor 25 is of a reciprocating type and is structured such that, when the piston 30 is moved reciprocatingly within a cylinder 28 which is open to an air suction portion 26 and a compressed air supply pipe 27, the compressor 25 compresses the air taken in from a suction port 26 and then feeds the compressed air to the compressed air supply pipe 27. In the suction port 26 and the mouth of the compressed air supply pipe 27, there are provided a suction valve 31 and a discharge valve (not shown) respectively, while the suction valve 31 and discharge valve are plate-shaped check valves which can be operated in the mutually opposite directions. The compressed air for supercharging is supplied from the compressed air supply pipe 27 to the combustion chamber 11.

The reciprocating motion of the piston 30 is carried out by a motor 32, a drive force is transmitted from the gear 33 of the motor shaft of the motor 32 through the meshing engagement between two bevel gears 34 to a crank gear 36, and the rotation of the crank gear 36 is transmitted to a connecting rod 37, whereby the piston 30 oscillatably held through a piston pin on the upper end of the connecting rod 37 can be moved reciprocatingly within the cylinder 28 for the above-mentioned suction and discharge of the air.

Also, on the lower portion of the grip 2, there is mounted a fuel supply device 19 containing the fuel cartridge 13. Gas fuel supplied from the fuel supply device 19 is supplied through a fuel supply pipe 38 into the combustion chamber 11. The fuel supply pipe 38 is connected to the intermediate portion of the pipe passage of the compression air supply pipe 27, and the gas fuel is supplied together with the compressed air from a compressed fuel supply pipe 39 into the combustion chamber 11.

Here, in order to be able to maintain a proper air-fuel ratio for securing a good combustion state, in the fuel supply device 19, there is provided a device which is used to adjust the fuel injection amount according to the air supply amount to the combustion chamber 11.

Next, when the contact member 23 is pushed in upwardly, it moves the movable housing 8 upwardly to thereby put the combustion chamber 11 into a closed state; and, in linking with the operation of a trigger, the compressor 25 for supercharging is driven by the motor 32 and thus the compressor 25 starts its operation, whereby the gas fuel can be supplied and can be ignited by the spark plug 12.

In other words, as the contact member 23 pressed against a member to be nailed (not shown) is pushed in upwardly in FIGS. 8 and 9, the movable housing 8 of the combustion chamber 11 is moved upwardly as shown in FIG. 9 to turn the combustion chamber 11 from the open state to the sealed and closed state; and also, as the compressor 25 is driven by the motor 32, the compressor 25 starts its operation to feed the compressed air through the compressed air supply pipe 27 and, simultaneously with this, the gas fuel is injected and supplied from the gas fuel cartridge 13 through the fuel supply pipe 38, so that the compressed air and fuel join together in the compressed fuel supply pipe 39 and are then supplied into the combustion chamber 11. The compressed air and fuel are stirred and mixed by the stirring fan 15 in such a manner that they are mixed uniformly; and, by operating a trigger 40, a microswitch S is turned ON to cause the spark plug 12 to carryout its igniting operation, thereby combusting the mixed fuel within the combustion chamber 11.

Since a high pressure gas resulting from the combustion of the mixed fuel within the combustion chamber 11 presses down the head valve 21 against the spring 22 to open its opening to the supply port 20, the combustion gas pressure is supplied into the striking cylinder 5 to drive the striking piston 6, whereby the driver 7 strikes against a nail to thereby drive it into a given position of the member to be nailed.

Also, when the striking piston 6 moves down to the bottom dead center thereof, the gas existing within the striking cylinder 5 cools suddenly and the volume of the gas decreases; and, therefore, the internal pressure of the striking cylinder 5 becomes negative and the striking piston 6 is thereby moved upwardly. As the striking piston 6 moves upwardly, the pressure of the space within the cylinder increases; and, due to such increased pressure, the opening of the check valve 17 of the separation member 16 is opened, and thus the striking piston 6 moves up to the top dead center thereof.

And, when, with the end of the nail driving operation, the operation of the trigger 40 is released and the pressing of the contact member 23 against the member to be nailed is removed, the contact member 23 is pressed down by the return force of the spring and is thereby moved downwardly and, in linking with the downward movement of the contact member 23, the movable sleeve portion of the combustion chamber 11 is moved downwardly to open the combustion chamber 11, whereby the fresh air is allowed to flow from the seal portion into the combustion chamber 11 to prepare a next nail driving operation.

First Exemplary Embodiment

According to a first exemplary embodiment of the invention, the gas internal combustion nailing machine includes a device (a safety device) which, when the supercharge pressure generated by compressed air to be supplied into the combustion chamber 11 for supercharging exceeds a set pressure value, can cut off the supply of the fuel to be supplied by the fuel supply device.

That is, as shown in FIG. 1, in the intermediate portion of a fuel supply pipe 38 for supplying a fuel gas from a fuel supply device 19, there is provided a control valve 41 serving as the safety device. Within the valve cylinder 42 of the control valve 41, there is arranged a valve body 43 slidably and the upper end of the valve cylinder 42 is connected to a pressure take-out pipe 44 which diverges from a compressed air supply pipe 27. Also, downwardly of the valve cylinder 42, there is disposed a push-up spring 45 which is used to energize the valve body 43 upwardly. Further, the fuel supply pipe 38 opens to the side wall of the valve cylinder 42.

When the supercharge pressure within the combustion chamber 11 is equal to or less than a given set pressure value, the valve body 43 of the control valve 41 is pushed upwardly by the push-up spring 45 as shown in FIG. 1 and the fuel supply pipe 38 is thereby opened, with the result that the gas fuel is supplied to the compressed air supply pipe 27 continuously.

Figure 2:
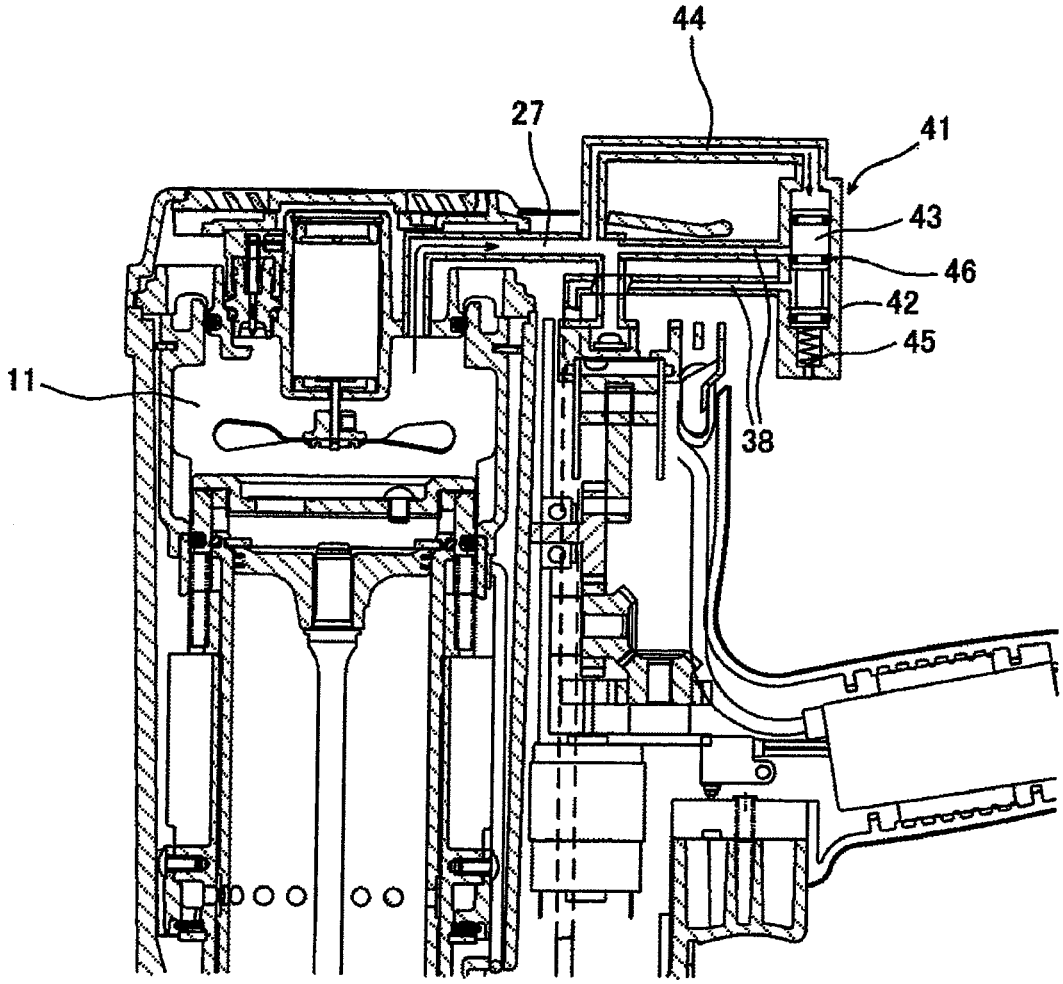
FIG. 2 is a longitudinal section view of the internal combustion type nailing machine shown in FIG. 1, showing the operation state thereof.

However, when the supercharge pressure within the combustion chamber 11 increases and exceeds the set pressure value, as shown in FIG. 2, the compressed air of high pressure is supplied from the compressed air supply pipe 27 through the pressure take-out pipe 44 into the valve cylinder 42 through the upper end thereof, whereby the valve body 43 is moved downwardly against the spring force of the push-up spring 45. With the downward movement of the valve body 43, the O ring 46 of the valve body 43 is moved to cut off the fuel supply pipe 38. This prevents the gas fuel from being supplied to the compressed air supply pipe 27.

As described above, when the supercharge pressure within the combustion chamber 11 exceeds the given set pressure value, the linking relationship between the supply of the compressed air for supercharging and the supply of the fuel is cut off. In other words, when the supercharge pressure within the combustion chamber 11 exceeds the given set pressure value, even if the supply of the compressed air for supercharging is carried out continuously, the fuel supply control valve 41 is operated to cut off the supply of the fuel. Therefore, when the supply of the compressed air is carried out continuously and the supercharge pressure within the combustion chamber 11 increases and exceeds the set pressure value, the fuel is diluted accordingly and thus a proper air-fuel ratio cannot be obtained. Due to this, the mixed gas cannot be combusted even when it is ignited, or the mixed gas can be combusted only incompletely, which can prevent the generation of such excessive explosion energy due to combustion under high supercharge pressure as can have ill influences on the durability and safety of the nailing machine.

Second Exemplary Embodiment

Figure 3:
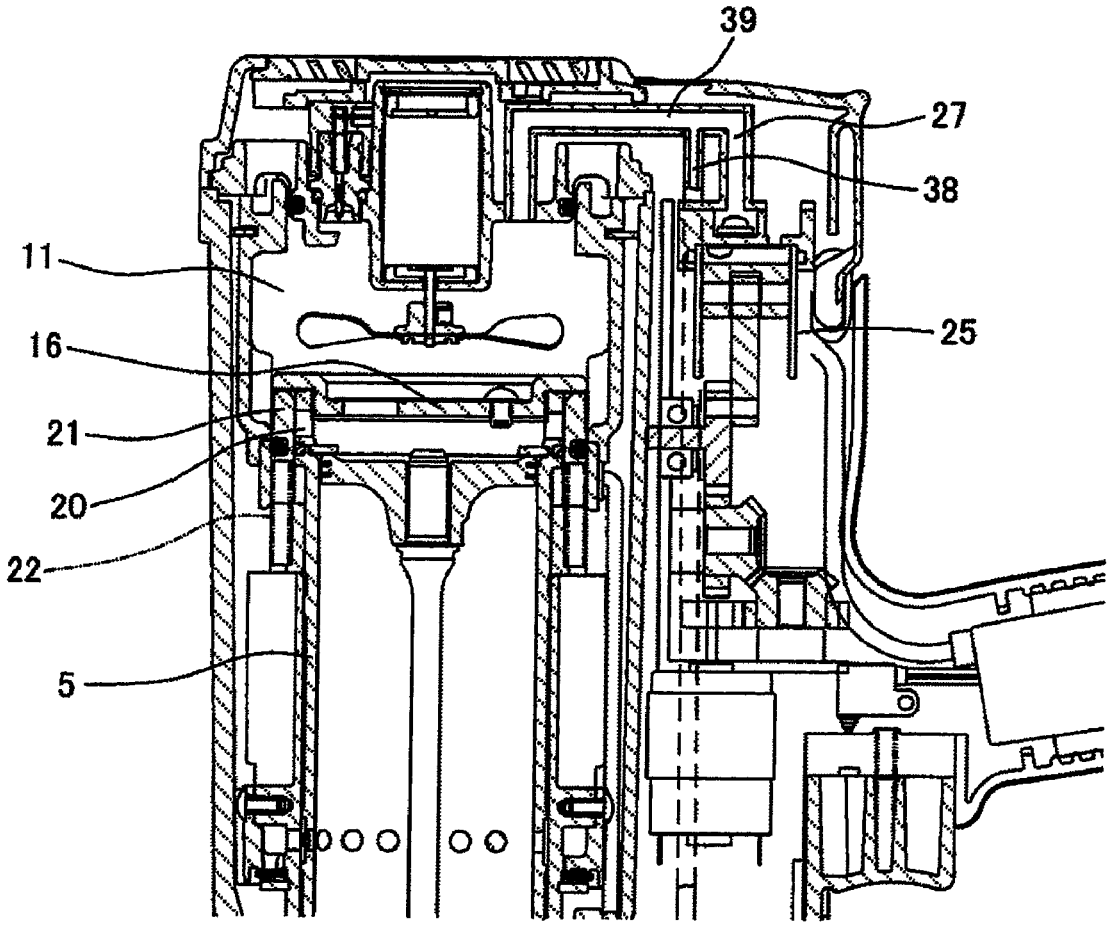
FIG. 3 is a longitudinal section view of the main portions of a gas internal combustion type nailing machine according to a second exemplary embodiment of the invention.

Next, description will be given below of a second exemplary embodiment according to the invention with reference to FIG. 3. According to the second exemplary embodiment, the nailing machine includes a device (a safety device) which, when the supercharge pressure generated by compressed air to be supplied into the combustion chamber 11 for supercharging exceeds a set pressure value, can release the supercharge pressure from within the combustion chamber 11 into the striking cylinder 5.

As described above, the gas fuel is supplied from the fuel supply device 19 (see FIG. 1) according to the supply amount of the compressed air to be supplied from a compressor 25, thereby being able to secure a proper air-fuel ratio. And, the compressed air supply pipe 27 and fuel supply pipe 38 are connected to each other directly; and, the fuel injected joins the compressed air and is then supplied from the compressed fuel supply pipe 39 into the combustion chamber 11.

Figure 4:
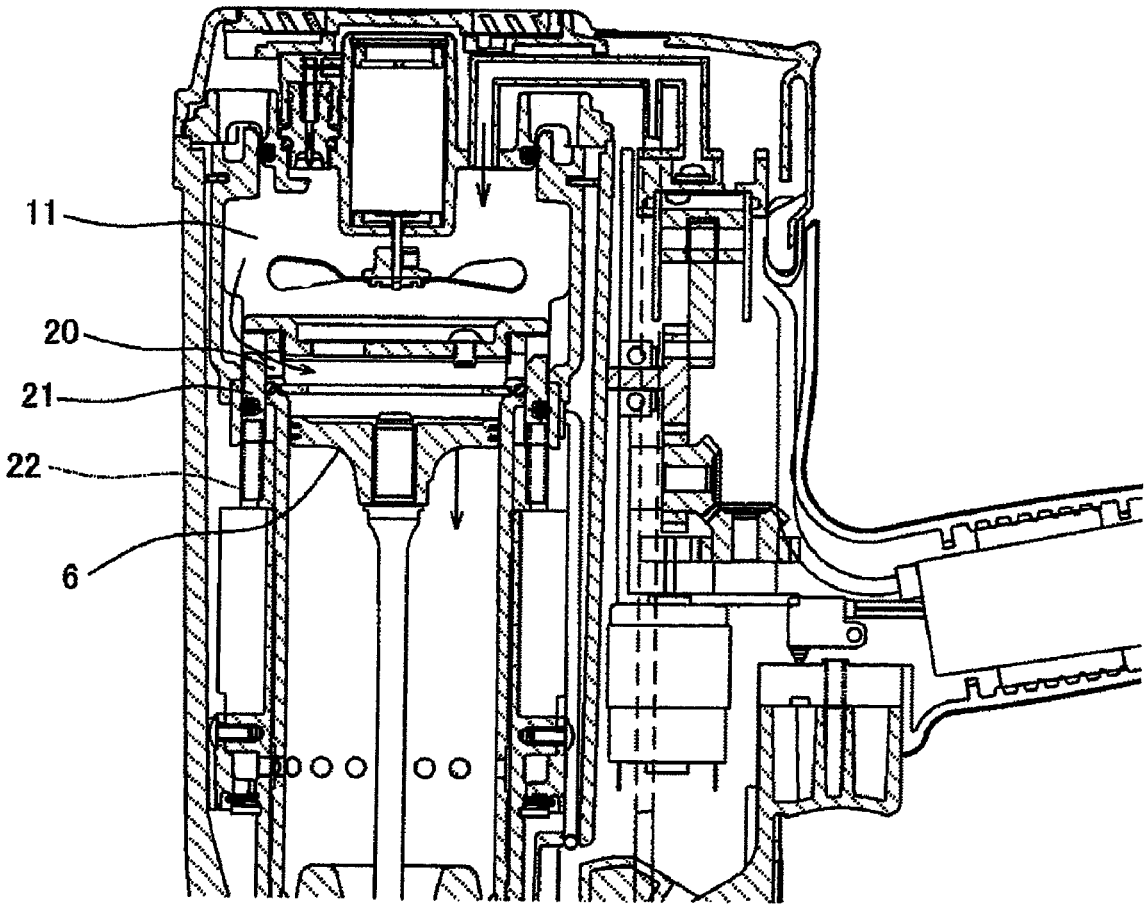
FIG. 4 is a longitudinal section view of the internal combustion type nailing machine shown in FIG. 3, showing the operation state thereof.

Here, in the above-mentioned separation member 16 which separates the lower portion of the combustion chamber 11 and also which forms a striking cylinder 5 internal space with respect to the upper portion of the striking piston 6 existing at the top dead center thereof, there is provided the head valve 21 which allows communication between the striking cylinder 5 internal space and combustion chamber 11 or can cut off such communication. Also, in the present embodiment, when the supercharge pressure within the combustion chamber 11 is equal to or less than a given set pressure value, this head valve 21 is normally moved upwardly with the push-up force of the push-up spring 22 to close the supply port 20 of the striking cylinder 5. On the other hand, when the supercharge pressure within the combustion chamber 11 exceeds the set pressure value, the head valve 21, as shown in FIG. 4, is moved downwardly against the push-up spring 22 to open the combustion chamber 11 to the supply port 20.

Therefore, when the supercharge pressure within the combustion chamber 11 generated due to supercharging exceeds the set pressure value, the head valve 21 is moved downwardly to open the combustion chamber 11 to the supply port 20 (see FIG. 3), whereby the mixed gas of high supercharge pressure flows into the striking cylinder 5 through the opening of the head valve 21. Owing to this, the striking piston 6 is pressed down by the above-mentioned supercharge pressure and thus the volume of the combustion chamber 11 is substantially expanded. That is, since an excess portion of the supercharge pressure within the combustion chamber 11 is released into the striking cylinder 5 internal space, the supercharge pressure within the combustion chamber 11 is decreased and explosion energy due to combustion is thereby reduced.

In this manner, as the supply port 20 is opened by the head valve 21, the mixed fuel of high supercharge pressure flows into the striking cylinder 5 internal space and, due to the flow of the mixed fuel, the pressure of the striking cylinder 5 internal space is increased to thereby operate the piston. However, since this pressure is lower than the pressure generated due to combustion, it can have no ill influences on the durability and safety of the nailing machine.

Third Exemplary Embodiment

Next, description will be given below of a nailing machine according to a third exemplary embodiment of the invention with reference to FIG. 5.

According to a third exemplary embodiment of the invention, the nailing machine includes a device (a safety device) which controls the electric circuit of a control substrate 35 of an ignition control unit according to a detect signal from a pressure sensor 47 for detecting such pressure within the combustion chamber 11 as exceeding the above-mentioned set pressure value to thereby prevent a switch S, which is used to carry out the above-mentioned ignition, from being turned ON.

Figure 5:
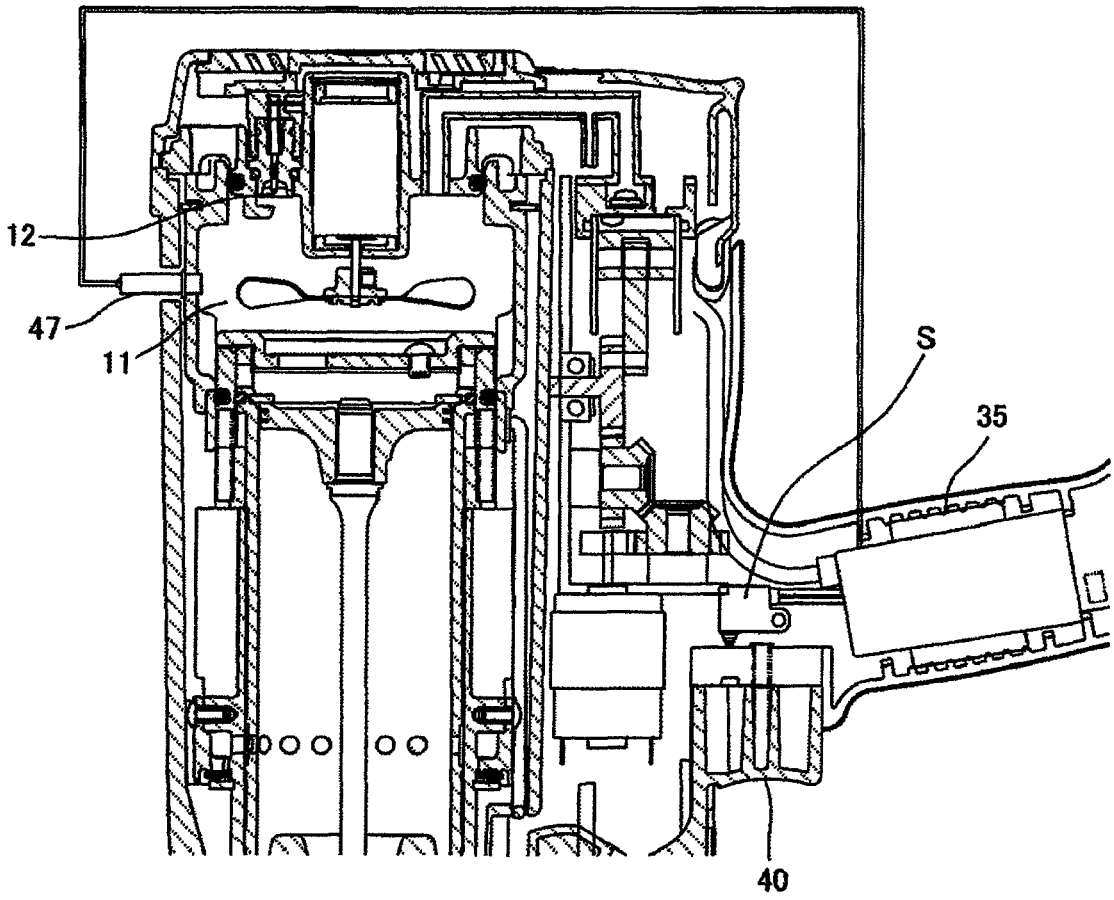
FIG. 5 is a longitudinal section view of the main portions of a gas internal combustion type nailing machine according to a third exemplary embodiment of the invention.

As shown in FIG. 5, on the side wall of the combustion chamber 11, there is mounted the pressure sensor 47; and, when the supercharge pressure within the combustion chamber 11 exceeds the set pressure value, the pressure sensor 47 detects this pressure state and emits a detect signal therefrom. And, the safety device is programmed such that, when the emitted detect signal is received, the signal can prevent the on-operation of the switch S for ignition which is arranged for the spark plug 12 of the electric circuit of the control substrate 35 included in the ignition control device.

Therefore, even when a trigger 40 is pushed in and the switch S is thereby turned ON, the turn-ON operation of the switch S is undone to thereby prevent the spark plug 12 against ignition, so that the mixed gas within the combustion chamber 11 is prevented against combustion.

Fourth Exemplary Embodiment

A fourth exemplary embodiment of the invention relates to a nailing machine including a mechanism, which, using a cylinder mechanism to be actuated according to such pressure within the combustion chamber as exceeding the above set pressure value, moves the contact member of a microswitch S, which is capable of igniting the spark plug 12 to thereby combust the mixed fuel within the combustion chamber 11, to a position where it cannot be engaged with the above-mentioned trigger. That is, the cylinder mechanism is provided so as to serve as a safety device.

Figure 6:
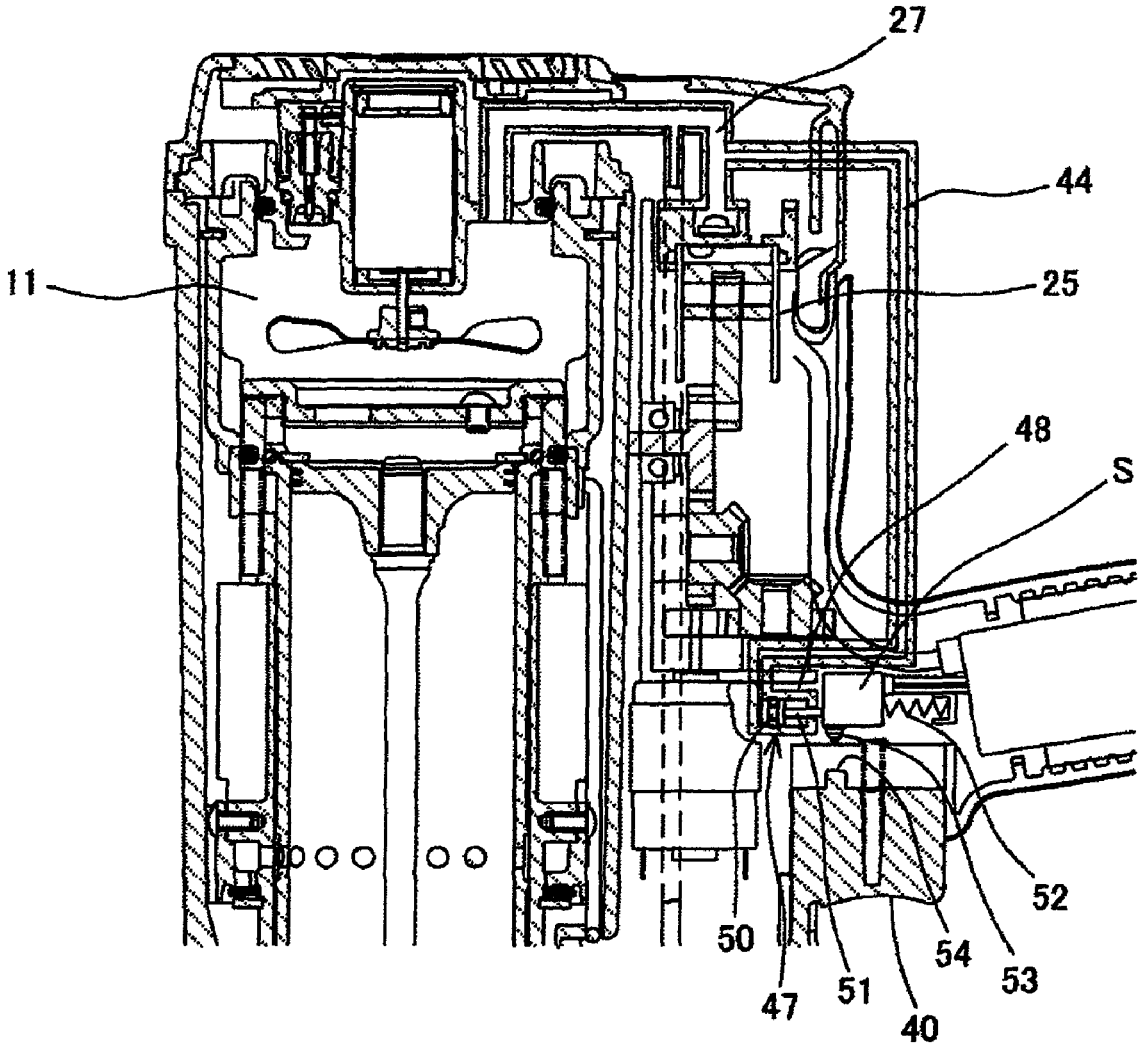
FIG. 6 is a longitudinal section view of the main portions of a gas internal combustion type nailing machine according to a fourth exemplary embodiment of the invention.

In other words, as shown in FIG. 6, a pressure take-out pipe 44, which is diverged from the pipe passage intermediate portion of a compressed air supply pipe 27 for supplying the compressed air from the above-mentioned compressor 25 into the combustion chamber 11, is connected to the cylinder 48 of the cylinder mechanism 47, whereby the supercharge pressure within the combustion chamber 11 can be applied directly into the cylinder 48 through the pressure take-out pipe 44. Within the cylinder 48, there are disposed a piston 50 and a piston rod 51, while the leading end of the piston rod 51 is projected from the cylinder 48 and is contacted with the front side surface of the microswitch S. The microswitch S is disposed such that it can be slid back and forth; and also, the microswitch S is energized by a spring 52 provided on the rear side surface thereof such that it is normally movable forwardly. The contact member 53 of the microswitch S is formed such that it projects downwardly.

On the other hand, on the upper end of the trigger 40, there is provided a switch pressing member 54 in such a manner that it corresponds in the vertical direction to the contact member 53 of the microswitch S held in a normal state.

Figure 7:
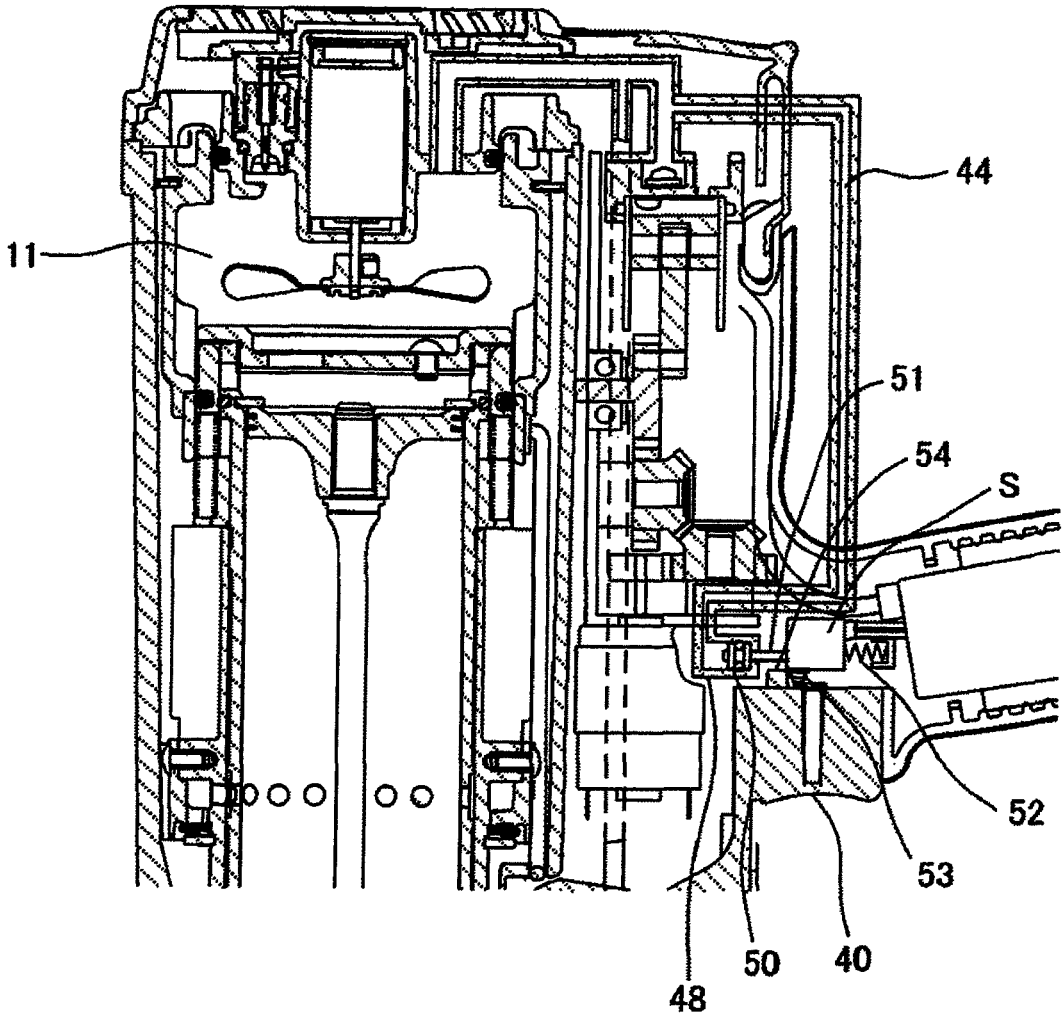
FIG. 7 is a longitudinal section view of the internal combustion type nailing machine shown in FIG. 6, showing the operation state thereof.

According to the above structure, when the supercharge pressure within the combustion chamber 11 is equal to or less than the set pressure value, the microswitch S is normally energized forwardly. On the other hand, as shown in FIG. 7, when the supercharge pressure within the combustion chamber 11 exceeds the set pressure value, due to such supercharge pressure, the piston rod 51, together with the piston 50 within the cylinder 48, slides the microswitch S backwardly against the spring 52, whereby the contact member 53 is moved to a position where it cannot be engaged with the trigger 40. Therefore, even when the trigger 40 is pulled up, the contact member 53 cannot be pushed in, so that the nailing machine can be prevented from starting.

By the way, description has been given here of the mechanical switch using the microswitch. However, this is not limitative but there may also be arranged an electric switch using a Hall element or the like.

Although not shown, instead of the above structure in which the contact member of the microswitch is moved to a position where it cannot be engaged with the trigger, there may also employed a structure in which the piston rod of the cylinder mechanism actuatable according to the pressure exceeding the above set pressure value is projected into the intermediate portion of the moving focus of the trigger to interfere with it.

Fifth Exemplary Embodiment

According to a fifth exemplary embodiment of the invention, the supercharge pressure provided by the compressor 25 and the fuel injection amount provided by the fuel supply device are linked with each other until the supercharge pressure reaches the set pressure value. On the other hand, when the supercharge pressure exceeds the set pressure value, the supercharge pressure provided by the compressor 25 and the fuel injection amount provided by the fuel supply device are not linked with each other but they are set individually from each other; and, from the fuel supply device containing the gas fuel cartridge 13 shown in FIGS. 8 and 9, there is injected a given amount of gas fuel. That is, the safety device, when the supercharge pressure exceeds the set pressure value, does not link the quantity of air to be supplied to the combustion chamber with the amount of fuel to be injected by the fuel supply device, but supplies a given amount of fuel using the fuel supply device.

According to the above structure, since, even when the supercharge pressure exceeds the set pressure value, the fuel injection amount is constant, the fuel injection amount does not increase any further. Owing to this, when only the supercharge pressure rises, in short, only the air amount increases when compared with the fuel gas and thus the mixed gas is diluted, so that the mixed gas cannot be combusted even when it is ignited or no power can be produced even when the mixed gas is combusted. Therefore, since the energy of the mixed gas becomes lower than the set energy, the durability and safety of the nailing machine can be secured.

Although the invention has been described heretofore in detail or with reference to the specific exemplary embodiments thereof, it is obvious to those skilled in the art that various changes and modifications are also possible without departing from the spirit and scope of the invention.

The present application is based on the Japanese Patent Publication (Patent Application No. 2007-096166) filed on Apr. 2, 2007 and thus the contents thereof are incorporated herein by reference.

INDUSTRIAL APPLICABILITY

The present invention can be applied to a gas internal combustion type nailing machine including a supercharge device.

The invention claimed is:

1. A gas internal combustion type nailing machine, comprising:

a striking cylinder for slidably accommodating a striking piston therein;

a combustion chamber formed in an upper side of the striking cylinder and capable of being opened and closed;

a separation member which separates a lower portion of the combustion chamber from an internal space in an upper portion of the striking cylinder;

a compressor for supercharging compressed air into the combustion chamber;

a fuel supply device for supplying a fuel gas into the combustion chamber; and a safety device for preventing the nailing machine from being ignited and driven when the supercharge pressure of the compressed air exceeds a set pressure value, wherein the safety device comprises a valve in the separation member configured to release the supercharge pressure from the combustion chamber into the striking cylinder when the supercharge pressure exceeds the set pressure value.

2. The gas internal combustion type nailing machine according to claim 1, wherein the supercharge pressure exceeding the set pressure value moves the safety device against a spring to open a port in the separation member to open the combustion chamber to the striking cylinder.

3. A gas internal combustion type nailing machine, comprising:

a striking cylinder for slidably accommodating a striking piston therein;

a combustion chamber formed in an upper side of the striking cylinder and capable of being opened and closed;

a compressor for supercharging compressed air into the combustion chamber;

a fuel supply device for supplying a fuel gas into the combustion chamber; and a safety device for preventing the nailing machine from being ignited and driven when the supercharge pressure of the compressed air exceeds a set pressure value, wherein the safety device comprises a control valve configured to cut off a supply of the fuel by the fuel supply device when the supercharge pressure exceeds the set pressure value.

4. A gas internal combustion type nailing machine, comprising:

a striking cylinder for slidably accommodating a striking piston therein;

a combustion chamber formed in an upper side of the striking cylinder and capable of being opened and closed;

a compressor for supercharging compressed air into the combustion chamber;

a fuel supply device for supplying a fuel gas into the combustion chamber; and a safety device for preventing the nailing machine from being ignited and driven when the supercharge pressure of the compressed air exceeds a set pressure value, wherein the safety device is configured to prevent a switch for igniting a mixed gas in the combustion chamber from being turned ON, by a control of an electric circuit of an ignition control device based on a detect signal from a pressure sensor for detecting a pressure in the combustion chamber which exceeds the set pressure value.

5. A gas internal combustion type nailing machine, comprising:

a striking cylinder for slidably accommodating a striking piston therein;

a combustion chamber formed in an upper side of the striking cylinder and capable of being opened and closed;

a compressor for supercharging compressed air into the combustion chamber;

a fuel supply device for supplying a fuel gas into the combustion chamber;

a safety device for preventing the nailing machine from being ignited and driven when the supercharge pressure of the compressed air exceeds a set pressure value; and a switch configured to be turned ON by operating a trigger and to ignite the mixed gas within the combustion chamber, wherein the safety device comprises a cylinder mechanism configured to operate to prevent the switch from turning ON based on a pressure in the combustion chamber which exceeds the set pressure value.

6. The gas internal combustion type nailing machine according to claim 5, wherein the cylinder mechanism is configured to operate based on the pressure in the combustion chamber which exceeds the set pressure value and to move a contact member of the switch to a position where the contact member does not engaged with the trigger.

7. The gas internal combustion type nailing machine according to claim 5, wherein the cylinder mechanism comprises a piston rod configured to operate based on the pressure in the combustion chamber which exceeds the set pressure value and to move to a position where the piston rod interferes with the trigger.

8. A gas internal combustion type nailing machine, comprising:

a striking cylinder for slidably accommodating a striking piston therein;

a combustion chamber formed in an upper side of the striking cylinder and capable of being opened and closed;

a compressor for supercharging compressed air into the combustion chamber;

a fuel supply device for supplying a fuel gas into the combustion chamber; and a safety device for preventing the nailing machine from being ignited and driven when the supercharge pressure of the compressed air exceeds a set pressure value, wherein the safety device is configured to supply a constant amount of fuel by the fuel supply device without linking an air supply amount with a fuel injection amount by the fuel supply device that are supplied to the combustion chamber, when the supercharge pressure exceeds the set pressure value.

* * * * *